US011802438B2

(12) United States Patent
Yamazaki

(10) Patent No.: US 11,802,438 B2
(45) Date of Patent: Oct. 31, 2023

(54) FIRE DOOR

(71) Applicant: Daifuku Co., Ltd., Osaka (JP)

(72) Inventor: Takafumi Yamazaki, Hinocho (JP)

(73) Assignee: Daifuku Co., Ltd., Osaka (JP)

( * ) Notice: Subject to any disclaimer, the term of this patent is extended or adjusted under 35 U.S.C. 154(b) by 93 days.

(21) Appl. No.: 17/473,021

(22) Filed: Sep. 13, 2021

(65) Prior Publication Data

US 2022/0081965 A1 Mar. 17, 2022

(30) Foreign Application Priority Data

Sep. 16, 2020 (JP) ..... 2020-155665

(51) Int. Cl.
*E06B 5/16* (2006.01)
*E06B 9/04* (2006.01)

(52) U.S. Cl.
CPC . *E06B 5/16* (2013.01); *E06B 9/04* (2013.01)

(58) Field of Classification Search
CPC ..... E06B 5/16; E06B 3/4407; E06B 3/4654; E06B 5/164; E06B 5/167; E06B 9/04; E05D 15/0665; E05D 15/0686; E05Y 2800/12; E05Y 2900/134
See application file for complete search history.

(56) References Cited

U.S. PATENT DOCUMENTS 5,282,656 A * 2/1994 Fizer ..... E05C 19/003 292/259 R
10,619,407 B2 * 4/2020 Kawabe ..... E06B 3/4654
2003/0067176 A1 * 4/2003 Stevens ..... E05B 17/2084 292/339
2016/0340966 A1 * 11/2016 Hosaka ..... E05D 15/063

FOREIGN PATENT DOCUMENTS

JP 2018204229 A 12/2018

* cited by examiner

*Primary Examiner* — Janet M Wilkens
*Assistant Examiner* — Susan M. Heschel
(74) *Attorney, Agent, or Firm* — THE WEBB LAW FIRM

(57) ABSTRACT

A fire door includes: an outer frame; a door body; and a center rail, the center rail is provided so as to overlap a target area in a wall orthogonal direction view, and so as to extend in a width direction between a first frame portion and a second frame portion on the side opposite to the wall body with respect to the target area, the center rail and the first frame portion are fixed to each other, the center rail and the second frame portion are engaged with each other with an engaging mechanism interposed therebetween, and the engaging mechanism is configured to allow relative movement of the center rail relative to the second frame portion in the width direction, and to regulate the relative movement thereof in the wall orthogonal direction and a slide direction.

6 Claims, 5 Drawing Sheets

FIRE DOOR

CROSS-REFERENCE TO RELATED APPLICATION

This application claims priority to Japanese Patent Application No. 2020-155665 filed Sep. 16, 2020, the disclosure of which is hereby incorporated by reference in its entirety.

BACKGROUND OF THE INVENTION

1. Field of the Invention

The present invention relates to a fire door that is to be attached to the wall surface of a wall body that has an opening.

2. Description of the Related Art

An example of the above-mentioned fire door is disclosed in JP 2018-204229A (Patent Document 1). Hereinafter, the reference numerals shown in parentheses in the description of the background technology are those shown in Patent Document 1.

The fire door according to Patent Document 1 includes an opening frame portion (7), a door body (8), and a guide mechanism (9), and the guide mechanism (9) guides the door body (8) in a slide direction Y so as to be movable from an open position to a closed position. Here, the door body (8) has a first facing surface that faces the wall body (2), and has a first facing surface, the opening frame portion (7) has a second facing surface that faces the first facing surface of the door body (8) located at the closed position, and the guide mechanism (9) moves the door body (8) so that the first facing surface of the door body (8) approaches the second facing surface as the door body (8) moves from the open position to the closed position.

In this fire door, when the door body in the open position is moved to the closed position along the slide direction, the first facing surface of the door body is in the state of approaching the second facing surface of the opening frame portion. Thus, the gap between the door body and the opening frame portion can be eliminated or reduced, and therefore the capability of the door body at the closed position to close the opening portion in the event of a fire can be improved.

SUMMARY OF THE INVENTION

However, with such a slidable fire door, when a fire occurs, the door body (8) and the opening frame portion (7) may expand due to the heat of the fire, and a gap may be generated. For example, when a center rail (a second vertical frame (15)) of the opening frame portion (7) expands due to heat and the gap with the door body (8) becomes large, the function of holding the door body (8) so as not to separate from the wall body (2) or the opening frame portion (7) deteriorates. As a result, the gap between the door body (8) and the wall body (2) or the opening frame portion (7) may become large, and the fire protection performance may be deteriorated.

Therefore, in the case of a slidable fire door, there is a demand for realizing a technique capable of suppressing the expansion of the gap with the door body due to the expansion of the center rail, and suppressing the deterioration of the center rail's function of holding the door body.

A fire door according to the present disclosure is a fire door that is to be attached to a wall surface of a wall body that has an opening, the fire door including: an outer frame that is fixed to the wall body; a door body that is guided by the outer frame so as to move in a slide direction along the wall surface, thereby opening and closing the opening; and a center rail that is attached to the outer frame, wherein, an area in which the door body is located in a state where the opening is closed is defined as a first area, an area in which the door body is located in a state where the opening is open is defined as a second area, a direction that is orthogonal to the wall surface of the wall body is defined as a wall orthogonal direction, a direction that is orthogonal to the slide direction in a wall orthogonal direction view that is a view in the wall orthogonal direction is defined as a width direction, the first area side with respect to the second area in the slide direction is defined as a slide direction first side, and the second area side with respect to the first area in the slide direction is defined as a slide direction second side, the outer frame includes a first frame portion that is located on a width direction first side that is one side in the width direction with respect to the first area and the second area, so as to extend in the slide direction, and a second frame portion that is located on a width direction second side that is the other side in the width direction with respect to the first area and the second area, so as to extend in the slide direction, the center rail is provided so as to overlap a target area in the wall orthogonal direction view, where the target area is an area on the slide direction second side in the first area with respect to the opening in the wall orthogonal direction view, and so as to extend in the width direction between the first frame portion and the second frame portion on the side opposite to the wall body with respect to the target area, the center rail and the first frame portion are fixed to each other, and the center rail and the second frame portion are engaged with each other with an engaging mechanism interposed therebetween, and the engaging mechanism is configured to allow relative movement of the center rail relative to the second frame portion in the width direction, and to regulate the relative movement thereof in the wall orthogonal direction and the slide direction.

With this configuration, the center rail can hold the target area of the door body from the side opposite to the wall body. Therefore, it is possible to prevent the gap between the door body and the wall body from increasing as a result of the door body expanding in a direction away from the wall body. In addition, the center rail itself also expands due to heat. However, while the center rail and the first frame portion are fixed to each other, the engaging mechanism is configured to allow the relative movement of the center rail relative to the second frame portion in the width direction. Therefore, even if the center rail expands due to heat at the time of a fire, the expansion can be released in the width direction so as to prevent the center rail from bending in a direction away from the door body and increasing the gap with the door body. Therefore, it is possible to suppress the deterioration of the center rail's function of holding the door body resulting from the expansion of the center rail.

As described above, with this configuration, in the case of a slidable fire door, it is possible to suppress the expansion of the gap with the door body due to the expansion of the center rail, and suppressing the deterioration of the center rail's function of holding the door body.

DETAILED DESCRIPTION OF PREFERRED EMBODIMENTS

1. Embodiment

Figure 1:
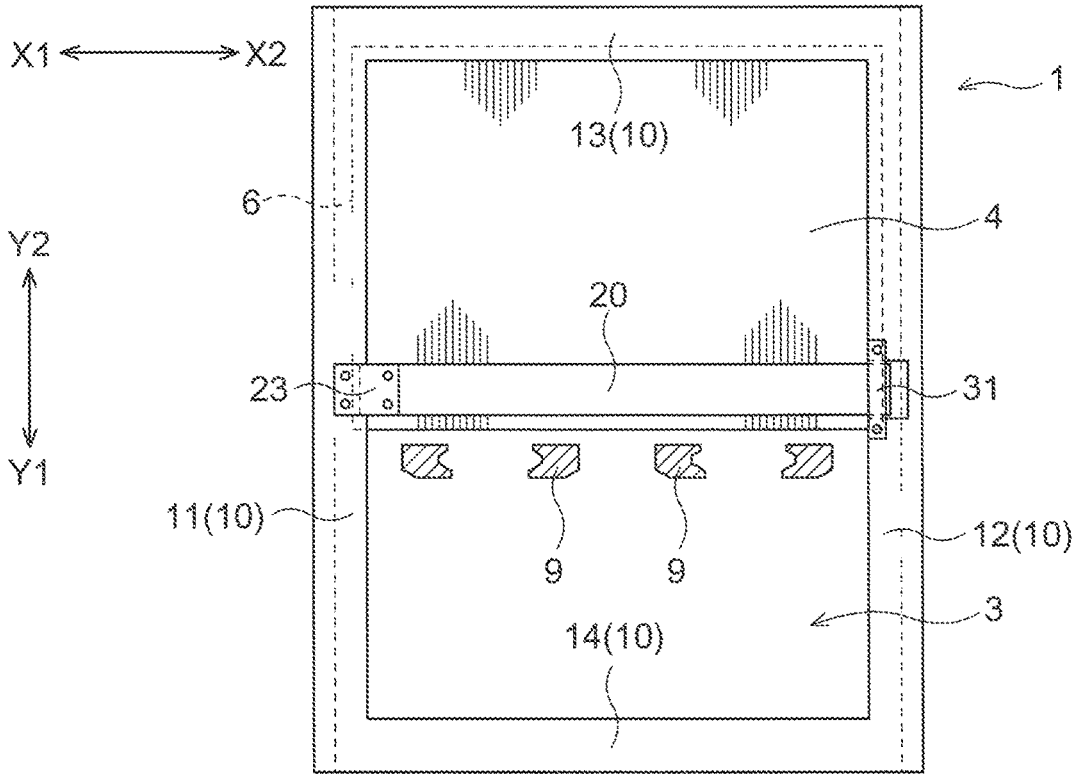
FIG. 1 is a front view of a fire door in a state where a door body thereof is located in a second area.

An embodiment of a slidable fire door will be described with reference to the drawings. In this embodiment, a fire door 1 is used for an article transport facility. As shown in FIG. 1, this article transport facility includes a wall body 2 that has an opening 3, a slidable fire door 1 provided on the wall body 2 to open and close the opening 3, and a travel rail 9 that supports a ceiling transport vehicle (not shown) and guides the ceiling transport vehicle along a travel route.

The travel rail 9 is provided so as to penetrate through the opening 3, and extends between an area on a wall orthogonal direction first side Z1 and an area on a wall orthogonal direction second side Z2 with respect to the wall body 2. The ceiling transport vehicle travels along the travel rail 9 so as to pass through the opening 3 in the wall orthogonal direction Z, to transport articles. Note that the direction orthogonal to the wall surface of the wall body 2 is defined as the wall orthogonal direction Z, one side in the wall orthogonal direction Z is defined as the wall orthogonal direction first side Z1, and the opposite side is defined as the wall orthogonal direction second side Z2.

In FIG. 1, the front side of the sheet of the drawing (the front side of the fire door 1) is the wall orthogonal direction first side Z1, and the back side of the sheet of the drawing (the back side of the fire door 1) is the wall orthogonal direction second side Z2.

The fire door 1 is provided on the wall surface that faces toward the wall orthogonal direction first side Z1, of the wall body 2. The fire door 1 is provided with an outer frame 10 that is fixed to the wall body 2, a door body 4 that opens and closes the opening 3 by moving along the wall surface in a slide direction Y while being guided by the outer frame 10, and a center rail 20 that is attached to the outer frame 10. In addition, in the present embodiment, the fire door 1 is also provided with a back center rail 40 attached to the outer frame 10.

Figure 4:
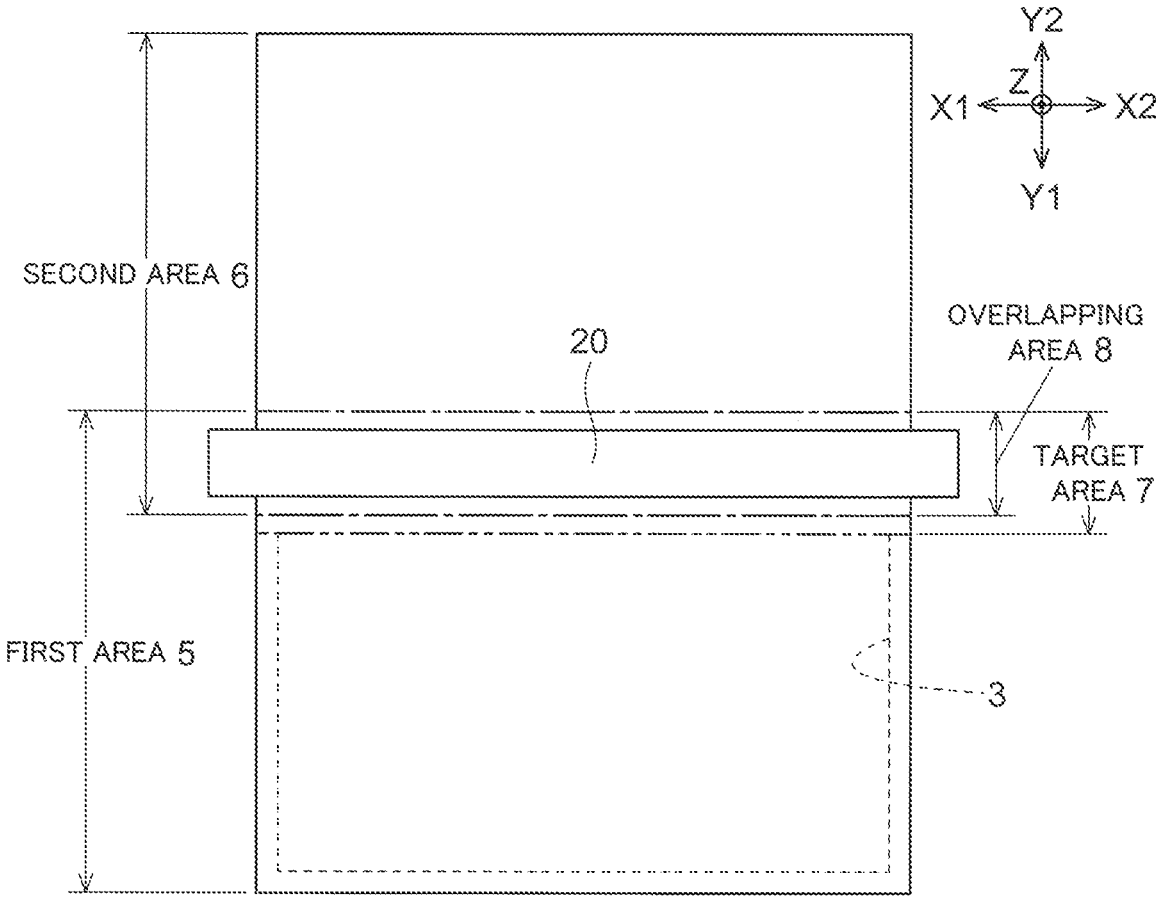
FIG. 4 is a conceptual diagram showing a positional relationship between areas provided on the fire door.

In the following description, as shown in FIG. 4, the area in which the door body 4 is located in a state where the opening 3 is closed is defined as a first area 5, and the area in which the door body 4 is located in a state where the opening 3 is open is defined as a second area 6. The direction orthogonal to the slide direction Y in a wall orthogonal direction Z view that is a view in the wall orthogonal direction Z is defined as a width direction X, the first area 5 side with respect to the second area 6 in the slide direction Y is defined as a slide direction first side Y1, and the second area 6 side with respect to the first area 5 in the slide direction Y is defined as a slide direction second side Y2. In the present embodiment, the fire door 1 is installed so that the slide direction Y coincides with the vertical direction.

1-1. Door Body

Figure 2:
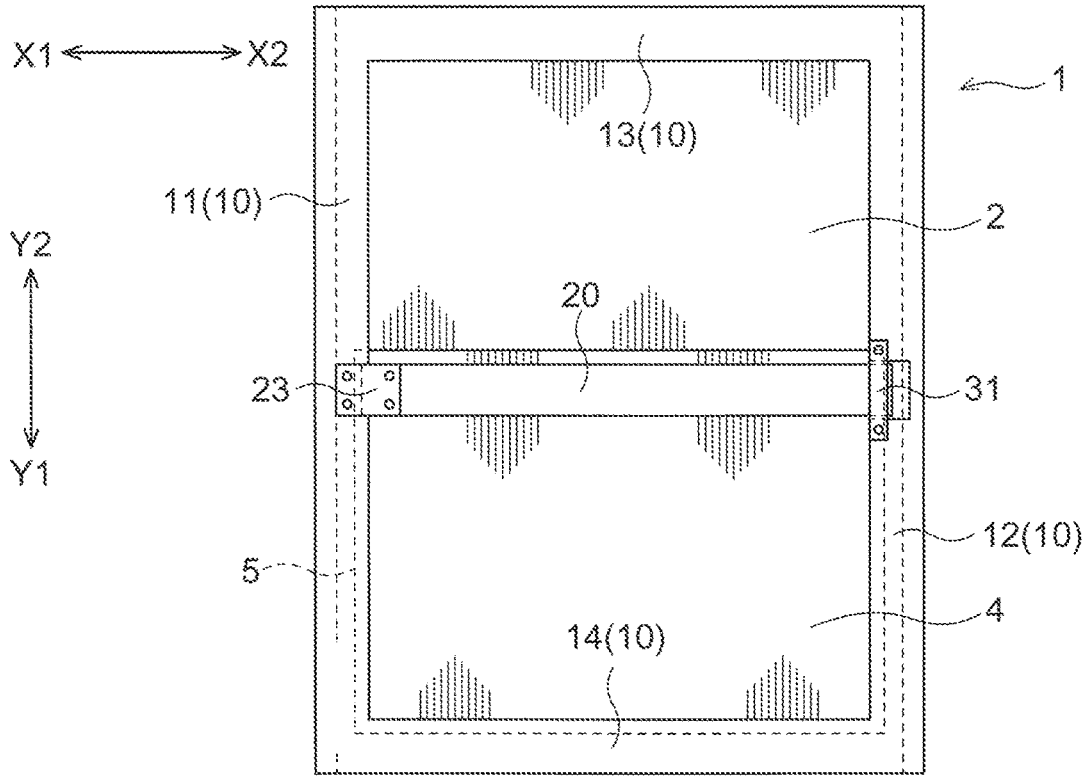
FIG. 2 is a front view of the fire door in a state where the door body thereof is located in a first area.

As shown in FIGS. 1 and 2, the door body 4 is orientated so as to extend in the slide direction Y and the width direction X. In the present embodiment, the door body 4 is formed in a plate shape. More specifically, the door body 4 has a rectangular shape in a wall orthogonal direction Z view, and is formed in a plate shape with a constant thickness in the wall orthogonal direction Z. The door body 4 is supported by the outer frame 10 so as to be movable in the slide direction Y. The door body 4 moved in the slide direction Y, and accordingly the area in which the door body 4 is provided changes between the second area 6 in which the door body 4 is provided in the state of opening the opening 3 and the first area 5 in which the door body 4 is provided in the state of closing the opening 3. As shown in FIG. 2, in a state where the door body 4 is located in the first area 5, the door body 4 covers the entire opening 3 in a wall orthogonal direction Z view. In this example, as shown in FIG. 1, in a state where the door body 4 is located in the second area 6, the door body 4 is located so as not to cover the entire opening 3 in a wall orthogonal direction Z view.

In the present embodiment, as shown in FIG. 4, the moving range of the door body 4 in the slide direction is set so that the first area 5 and the second area 6 partially overlap each other. That is to say, the moving range of the door body 4 in the slide direction Y is set so that the overlapping area of the first area 5 and the second area 6 constitutes an overlapping area 8.

1-2. Outer Frame

The outer frame 10 includes a first frame portion 11 that is located on a width direction first side X1, which is one side in the width direction X with respect to the first area 5 and the second area 6, so as to extend in the slide direction Y, and a second frame portion 12 that is located on a width direction second side X2, which is the other side in the width direction X with respect to the first area 5 and the second area 6, so as to extend in the slide direction Y. In addition, in the present embodiment, the outer frame 10 also includes a third frame portion 13 that connects an end portion of the first frame portion 11 on the slide direction second side Y2 and an end portion of the second frame portion 12 on the slide direction second side Y2, and a fourth frame portion 14 that connects an end portion of the first frame portion 11 in on the slide direction first side Y1 and the slide direction first side Y1 of the second frame portion 12.

The first frame portion 11 and the second frame portion 12 are elongated members. In the present embodiment, the first frame portion 11 and the second frame portion 12 are each formed in a rectangular shape that is elongated in the slide direction Y in a wall orthogonal direction Z view. The first frame portion 11 and the second frame portion 12 are separated from each other in the width direction X so as not to overlap the opening 3 in a wall orthogonal direction Z view. Also, the first frame portion 11 is provided so as to extend in the slide direction Y, at a position in the width direction X at which the first frame portion 11 overlaps end portions of the first area 5 and the second area 6 on the width direction first side X1, which are the areas in which the door body 4 is to be located in a wall orthogonal direction Z view. Similarly, the second frame portion 12 is provided so as to extend in the slide direction Y, at a position in the width direction X at which the second frame portion 12 overlaps end portions of the first area 5 and the second area 6 on the width direction second side X2 in a wall orthogonal direction Z view. With such an arrangement, the outer frame 10 can guide the door body 4 so as to be movable in the slide direction Y, and can close the entire opening 3 with the door body 4 in a state where the door body 4 is located in the first area 5.

Figure 3:
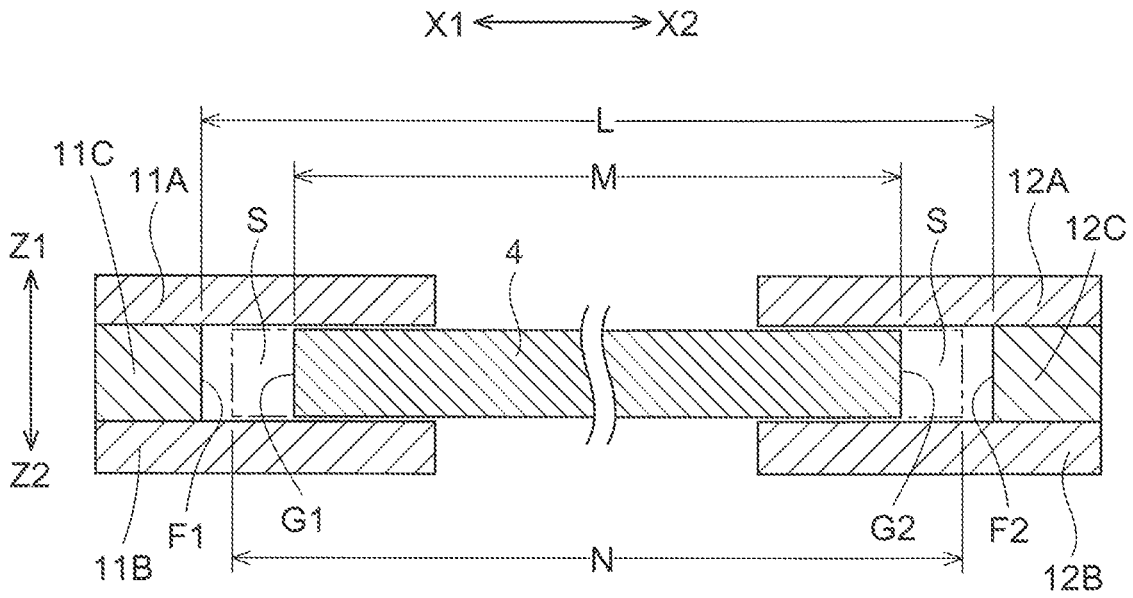
FIG. 3 is a cross-sectional view that is orthogonal to a slide direction of the door body and an outer frame.

In the present embodiment, as shown in FIG. 3, the first frame portion 11 includes a first front-side main body 11A, a first wall-side main body 11B, and a first intermediate member 11C. In this example, the first front-side main body 11A, the first wall-side main body 11B, and the first intermediate member 11C are each formed in a rectangular plate shape that is elongated in the slide direction Y.

The first front-side main body 11A and the first wall-side main body 11B have the same dimensions in the width direction X and the slide direction Y. Note that, in the example shown in the drawings, the first front-side main body 11A and the first wall-side main body 11B have the same dimension in the wall orthogonal direction Z as well. The first intermediate member 11C has the same dimension as the first front-side main body 11A and the first wall-side main body 11B in the slide direction Y, but the dimension thereof in the width direction X is set to be smaller than the dimension of the first front-side main body 11A and the first wall-side main body 11B. Also, in the example shown in the drawings, the dimension of the first intermediate member 11C in the wall orthogonal direction Z is set to be larger than the dimension of the first front-side main body 11A and the first wall-side main body 11B in the wall orthogonal direction Z.

The first wall-side main body 11B is located on the wall body 2 side with respect to the door body 4. The first front-side main body 11A is located on the side opposite to the wall body 2 with respect to the door body 4. The first intermediate member 11C is located so as to connect the first wall-side main body 11B and the first front-side main body 11A in the wall orthogonal direction Z. Also, the first intermediate member 11C is located so that the end portion thereof on the width direction first side X1 coincides with the end portions of the first wall-side main body 11B and the first front-side main body 11A, and the first intermediate member 11C is located so as to span the entire ranges of the first wall-side main body 11B and the first front-side main body 11A in the slide direction Y. As a result, the first frame portion 11 is formed in a recessed shape whose cross section that is orthogonal to the slide direction Y is open toward the width direction second side X2. Note that, in this example, the first front-side main body 11A, the first wall-side main body 11B, and the first intermediate member 11C are fixed to each other using fixing members such as bolts, or through welding.

In the present embodiment, the second frame portion 12 includes a second front-side main body 12A, a second wall-side main body 12B, and a second intermediate member 12C. In this example, the second front-side main body 12A, the second wall-side main body 12B, and the second intermediate member 12C are each formed in a rectangular plate shape that is elongated in the slide direction Y.

The second front-side main body 12A and the second wall-side main body 12B have the same dimensions in the width direction X and the slide direction Y. Note that, in the example shown in the drawings, the second front-side main body 12A and the second wall-side main body 12B have the same dimension in the wall orthogonal direction Z as well. The second intermediate member 12C has the same dimension as the second front-side main body 12A and the second wall-side main body 12B in the slide direction Y, but the dimension thereof in the width direction X is set to be smaller than the dimension of the second front-side main body 12A and the second wall-side main body 12B. Also, in the example shown in the drawings, the dimension of the second intermediate member 12C in the wall orthogonal direction Z is set to be larger than the dimension of the second front-side main body 12A and the second wall-side main body 12B in the wall orthogonal direction Z.

The second wall-side main body 12B is located on the wall body 2 side with respect to the door body 4. The second front-side main body 12A is located on the side opposite to the wall body 2 with respect to the door body 4. The second intermediate member 12C is located so as to connect the second wall-side main body 12B and the second front-side main body 12A in the wall orthogonal direction Z. Also, the second intermediate member 12C is located so that the end portion thereof on the width direction second side X2 coincides with the end portions of the second wall-side main body 12B and the second front-side main body 12A, and the second intermediate member 12C is located so as to span the entire ranges of the second wall-side main body 12B and the second front-side main body 12A in the slide direction Y. As a result, the second frame portion 12 is formed in a recessed shape whose cross section that is orthogonal to the slide direction Y is open toward the width direction first side X1. Note that, in this example, the second front-side main body 12A, the second wall-side main body 12B, and the second intermediate member 12C are fixed to each other using fixing members such as bolts, or through welding.

Also, the first frame portion 11 and the second frame portion 12 are configured such that, when the surface that faces the door body 4 in the width direction X of the first frame portion 11 is defined as a first facing surface F1 and the surface that faces the door body 4 in the width direction X of the second frame portion 12 is defined as a second facing surface F2, and a distance L between the first facing surface F1 and the second facing surface F2 in the width direction X is larger than a dimension N obtained by adding the amount of expansion of the door body 4 in the width direction X caused by overheating at the time of fire to a dimension M of the door body 4 in the width direction X at room temperature (L>N>M). That is to say, the door body 4 is located so as to have gaps with the first facing surface F1 of the first frame portion 11 and the second facing surface F2 of the second frame portion 12 in the width direction X. The gaps are formed so as to span the entire ranges of the first frame portion 11 and the second frame portion 12 in the slide direction Y. The dimension of the gaps in the width direction X are set to be larger than the amount of expansion of the door body 4 in the width direction X caused by overheating at the time of fire. Therefore, even if the door body 4 expands due to overheating, the two ends of the door body 4 in the width direction X do not abut against the first facing surface F1 and the second facing surface F2 so that the thermal expansion of the door body 4 is not prevented. Therefore, the door body 4 is prevented by the first frame portion 11 and the second frame portion 12 from expanding in the width direction X, and accordingly the door body 4 can be prevented from bending in the wall orthogonal direction Z. Therefore, it is possible to prevent the gap between the door body 4 and the wall body 2 or the outer frame 10 from expanding due to the curvature caused by the expansion of the door body 4, and prevent a fire flame from passing through the gap to the opposite side of the fire door 1.

In the present embodiment, the surface of the first intermediate member 11C on the width direction second side X2 is the first facing surface F1. The first facing surface F1 faces a first door surface G1 that is the surface of the door body 4 on the width direction first side X1. The surface of the second intermediate member 12C on the width direction first side X1 is the second facing surface F2. The second facing surface F2 faces a second door surface G2 that is the surface of the door body 4 on the width direction second side X2. Therefore, a space S is formed between the first facing surface F1 and the first door surface G1. Similarly, a space S is formed between the second facing surface F2 and the second door surface G2 as well. FIG. 3 shows a state in which the door body 4 is located at the midpoint between the first facing surface F1 and the second facing surface F2 in the width direction X, and therefore the distance between the first facing surface F1 and the first door surface G1 in the width direction X and the distance between the second facing surface F2 and the second door surface G2 in the width direction X are the same.

Note that, in this example, the dimension M of the door body 4 in the width direction X at room temperature is, for example, the dimension M of the door body 4 in the width direction X in a 20° C. environment. The dimension N obtained by adding the amount of expansion of the door body 4 in the width direction X caused by overheating at the time of fire is the dimension expanded by the heat at the highest temperature that is assumed in an actual fire. Here, it is preferable that the highest temperature assumed in an actual fire is set to a temperature that is no less the temperature at which the fire door 1 is heated in a standard test (for example, a JIS standard test or the like).

The third frame portion 13 and the fourth frame portion 14 are elongated members. In the present embodiment, the third frame portion 13 and the fourth frame portion 14 are each formed in a rectangular shape that is elongated in the width direction X in a wall orthogonal direction Z view. The third frame portion 13 and the fourth frame portion 14 are configured to connect the first frame portion 11 and the second frame portion 12 in the width direction X.

In the present embodiment, as shown in FIGS. 1 and 2, the third frame portion 13 is provided so as to extend in the width direction X between the end portion of the first frame portion 11 on the slide direction second side Y2 and the end portion of the second frame portion 12 on the slide direction second side Y2. The end portion of the third frame portion 13 on the width direction first side X1 is connected to the first frame portion 11, and the end portion of the third frame portion 13 on the width direction second side X2 is connected to the second frame portion 12. Although the details of the structure of the third frame portion 13 are not illustrated here, a cross section of the third frame portion 13 orthogonal to the width direction X is formed in a recessed shape that opens toward the slide direction first side Y1. To realize such a shape, it is preferable that the third frame portion 13 has the same structure as the first frame portion 11 and the second frame portion 12.

Also, the fourth frame portion 14 is provided so as to extend in the width direction X between the end portion of the first frame portion 11 on the slide direction first side Y1 and the end portion of the second frame portion 12 on the slide direction first side Y1. The end portion of the fourth frame portion 14 on the width direction first side X1 is connected to the first frame portion 11, and the end portion of the fourth frame portion 14 on the width direction second side X2 is connected to the second frame portion 12. Although the details of the structure of the fourth frame portion 14 are not illustrated here, a cross section of the fourth frame portion 14 orthogonal to the width direction X is formed in a recessed shape that opens toward the slide direction second side Y2. To realize such a shape, it is preferable that the fourth frame portion 14 has the same structure as the first frame portion 11 and the second frame portion 12.

1-3. Center Rail

As shown in FIG. 4, the center rail 20 is provided so as to overlap a target area 7 in a wall orthogonal direction Z view, where the target area 7 is an area on the slide direction second side Y2 in the first area 5 with respect to the opening 3 in a wall orthogonal direction Z view. The center rail 20 is provided so as to extend in the width direction X between the first frame portion 11 and the second frame portion 12 on the side opposite to the wall body 2 with respect to the target area 7. As a result, the center rail 20 is provided at a position at which the center rail 20 does not overlap the opening 3 in a wall orthogonal direction Z view, and can support the door body 4 provided in the first area 5 to close the opening 3, on an area on the slide direction second side Y2, from the wall orthogonal direction first side Z1.

Also, in the present embodiment, as described above, the moving range of the door body 4 in the slide direction Y is set so that the overlapping area of the first area 5 and the second area 6 of the door body 4 constitutes an overlapping area. Therefore, the overlapping area 8 is formed within the target area 7. In the present embodiment, the center rail 20 is located so as to overlap the overlapping area 8 as well. By providing the center rail 20 at such a position, the center rail 20 is located at a position at which the center rail 20 overlaps the door body 4 in a wall orthogonal direction Z view in both the state where the door body 4 closes the opening 3 and the state where the door body 4 opens the opening 3. Therefore, the door body 4 is appropriately reinforced by the center rail 20 in both the case of a fire and the case of a normal time when no fire has occurred.

Figure 5:
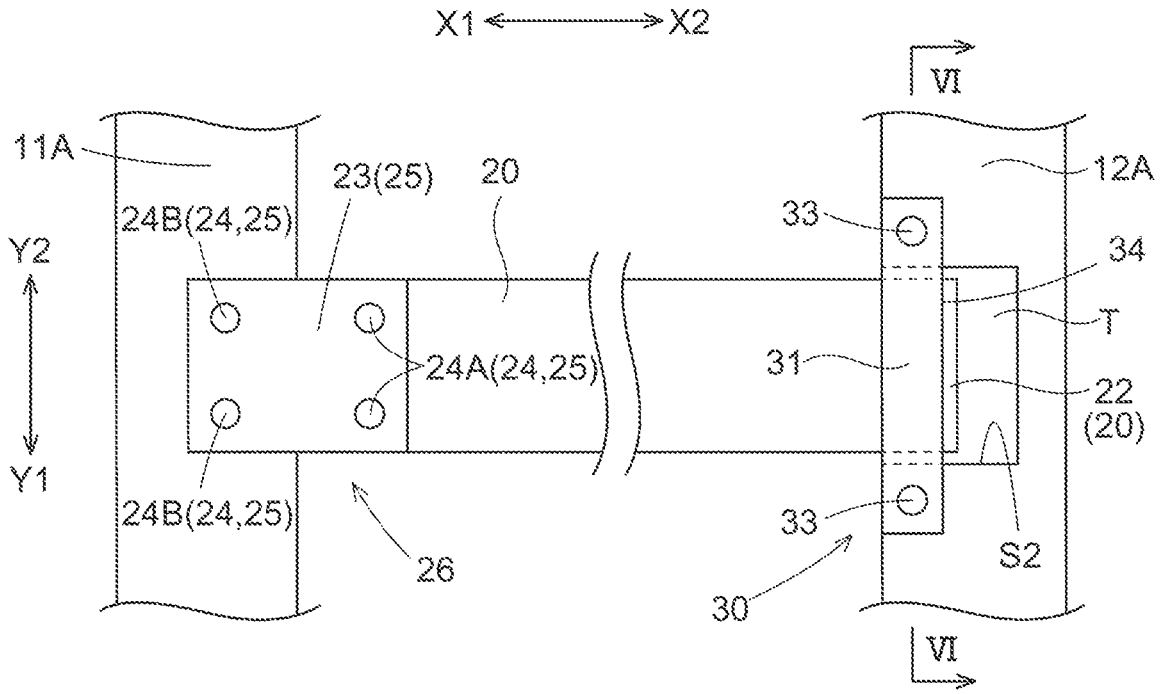
FIG. 5 is a front view of a center rail and the outer frame.
Figure 7:
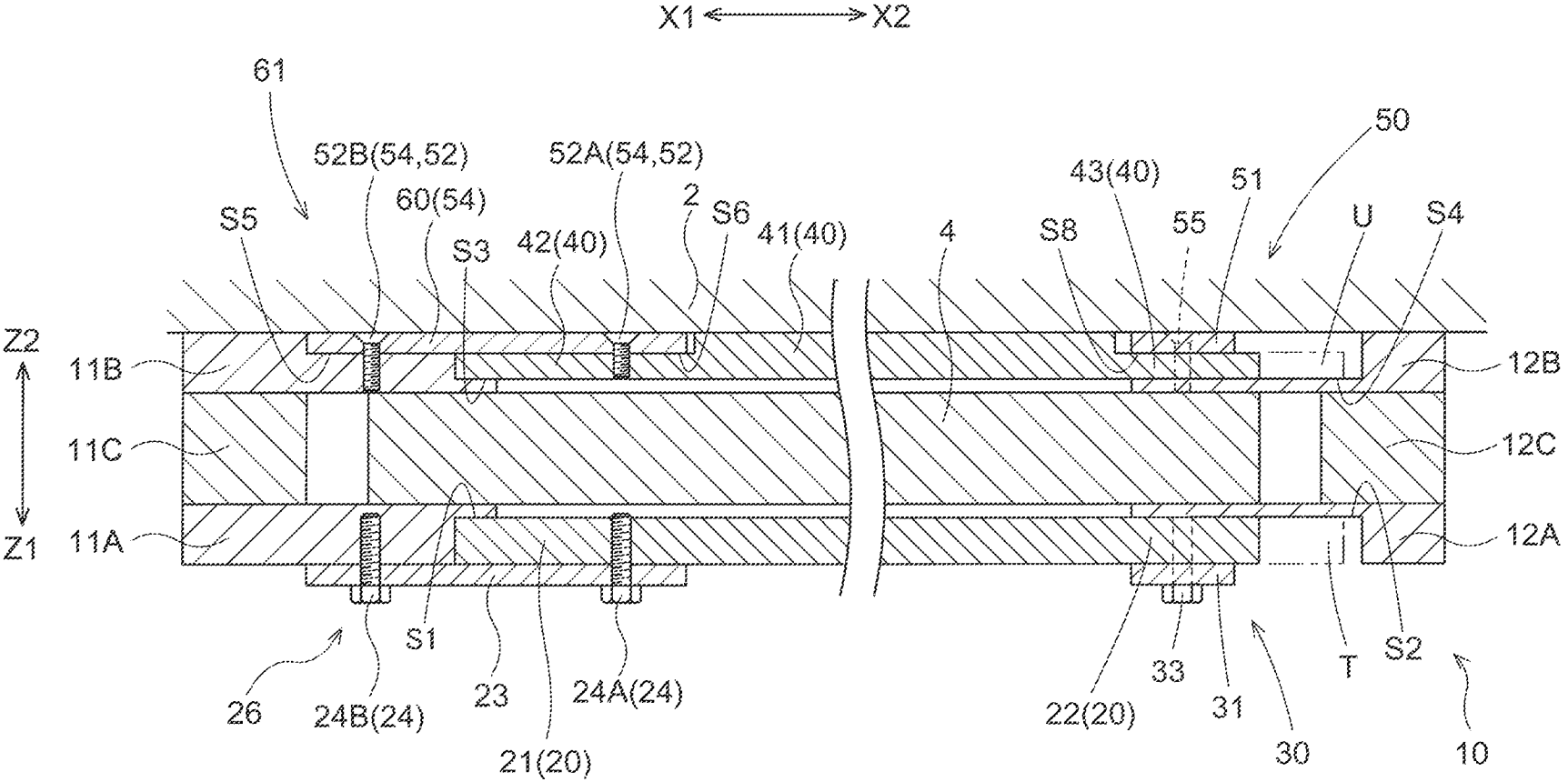
FIG. 7 is a cross-sectional view that is orthogonal to a slide direction of the center rail, a back center rail, and the outer frame.

As shown in FIGS. 5 and 7, the center rail 20 and the first frame portion 11 are fixed to each other, and the center rail 20 and the second frame portion 12 are engaged with each other with an engaging mechanism 30 interposed therebetween. The engaging mechanism 30 is configured to allow the relative movement of the center rail 20 relative to the second frame portion 12 in the width direction X, and to regulate the relative movement thereof in the wall orthogonal direction Z and the slide direction Y. As described above, the door body 4 thermally expands due to the heat of a fire, but in the event of a fire, the center rail 20 also expands due to heat. According to this configuration, the center rail 20 and the first frame portion 11 are fixed to each other, while the engagement mechanism 30 allows the center rail 20 to move relative to the second frame portion 12 in the width direction X. Therefore, even if the center rail 20 expands due to heat at the time of a fire, the expansion can be released in the width direction X. Therefore, it is possible to prevent the center rail 20 from bending away from the door body 4 and expanding the gap with the door body 4, and it is possible to suppress the deterioration of the center rail 20's function of holding the door body 4.

In the present embodiment, a portion that overlaps the first frame portion 11 in a wall orthogonal direction Z view, of the center rail 20, is defined as a first portion 21, a portion that overlaps the second frame portion 12 in a wall orthogonal direction Z view, of the center rail 20, is defined as a second portion 22, the first portion 21 is fixed to the first frame portion 11, and the second portion 22 is engaged with the second frame portion 12 with the engaging mechanism 30 described later interposed therebetween (FIG. 7). With this configuration, the first portion 21 that overlaps the first frame portion 11, of the center rail 20, is fixed to the first frame portion 11, and therefore the center rail 20 and the first frame portion 11 can be firmly fixed to each other using a simple configuration. Also, the second frame portion 12 that overlaps the second portion 22, of the center rail 20, is engaged with the second frame portion 12 with the engaging mechanism 30 interposed therebetween, and therefore it is easier to realize the engaging mechanism 30 with a simple configuration. The configuration of the engaging mechanism 30 will be described later in detail.

In the present embodiment, the center rail 20 is a member that is elongated in the width direction X. In the example shown in the drawings, the center rail 20 is formed in a rectangular plate shape in a wall orthogonal direction Z view. The dimension of the center rail 20 in the width direction X is set to be longer than the dimension of the door body 4. Furthermore, in this example, the dimension of the center rail 20 in the width direction X is shorter than the dimension of the outer edge of the outer frame 10 in the width direction X. As a result, in this example, in a state where the center rail 20 is attached to the outer frame 10, the first portion 21 that overlaps the first frame portion 11 in a wall orthogonal direction Z view is formed at an end portion of the center rail 20 on the width direction first side X1. Also, the second portion 22 that overlaps the second frame portion 12 in a wall orthogonal direction Z view is formed at an end portion of the center rail 20 on the width direction second side X2.

Next, the configuration of a portion in which the center rail 20 and the first frame portion 11 are fixed to each other, i.e., the configuration of a fixing portion 26, will be described. As shown in FIGS. 5 and 7, in the fixing portion 26, the center rail 20 overlaps the first frame portion 11 and is fixed by a fixing member 25. The fixing portion 26 is located in an area of the center rail 20 on the width direction first side X1, which includes the first portion 21. In this example, the first portion 21 of the center rail 20 is placed on top of the first frame portion 11 and is fixed by the fixing member 25 to form the fixing portion 26.

The fixing member 25 includes a plate-shaped member 23 that has a flat plate shape, and a first fastening member 24. In this example, the first fastening member 24 includes a first fastening bolt 24A and a second fastening bolt 24B. The first fastening bolt 24A is inserted through the plate-shaped member 23 and the center rail 20 in the wall orthogonal direction Z, and fastens them to each other. The second fastening bolt 24B is inserted through the plate-shaped member 23 and the first frame portion 11 in the wall orthogonal direction Z, and fastens them to each other.

In the present embodiment, the plate-shaped member 23 has a rectangular shape elongated in the width direction X. Also, in this example, the plate-shaped member 23 has the same dimension as the center rail 20 in the slide direction Y. The dimension of the plate-shaped member 23 in the width direction X is longer than the dimension of the first portion 21.

As shown in FIG. 7, in the present embodiment, a first recessed portion S1 is formed in the first front-side main body 11A of the first frame portion 11. The first recessed portion S1 is formed so as to be partially recessed toward the wall orthogonal direction second side Z2 with respect to the surface of the first front-side main body 11A on the most wall orthogonal direction first side Z1. Here, the first recessed portion S1 is formed in a range in the slide direction Y so as to have a dimension no less than the dimension of the first portion 21 of the center rail 20 in the slide direction Y. The first recessed portion S1 is formed by being surrounded by a surface that faces toward the wall orthogonal direction first side Z1, a surface that faces toward the width direction second side X2, and a pair of surfaces that face each other in the slide direction Y. The first portion 21 of the center rail 20 fits in the first recessed portion S1.

The plate-shaped member 23 is placed on top of the center rail 20 and the first frame portion 11 from the wall orthogonal direction first side Z1 in a state where the first portion 21 of the center rail 20 fits in the first recessed portion S1. As shown in FIG. 5, in this example, the plate-shaped member 23 is placed on top of the center rail 20 so that the two edges thereof in the slide direction Y respectively align with the two edges of the center rail 20 in the slide direction Y. Furthermore, in the width direction X, as shown in FIGS. 5 and 7, the plate-shaped member 23 is placed on top of the first front-side main body 11A, the first portion 21, and a portion of the center rail 20 on the width direction second side X2 relative to the first portion 21.

The first fastening bolt 24A is inserted into the plate-shaped member 23 and the first front-side main body 11A from the wall orthogonal direction first side Z1, and the plate-shaped member 23 and the first front-side main body 11A are fastened to each other. Also, the second fastening bolt 24B is inserted into the plate-shaped member 23 and the center rail 20 from the wall orthogonal direction first side Z1, and the plate-shaped member 23 and the center rail 20 are fastened to each other. With this configuration, the first front-side main body 11A of the first frame portion 11 and the center rail 20 are fixed to each other, using the plate-shaped member 23.

1-4. Engaging Mechanism

As described above, the engaging mechanism 30 is configured to allow the relative movement of the center rail 20 relative to the second frame portion 12 in the width direction X, and to regulate the relative movement thereof in the wall orthogonal direction Z and the slide direction Y. With this configuration, even if the center rail 20 expands due to heat at the time of a fire, the expansion can be released in the width direction X. Furthermore, the engaging mechanism 30 is configured to regulate the center rail 20 from moving in the wall orthogonal direction Z or the slide direction Y relative to the second frame portion 12. With this configuration, the position of the second portion 22 of the center rail 20, specifically the position thereof in the wall orthogonal direction Z and the slide direction Y can be appropriately kept at the same position.

Figure 6:
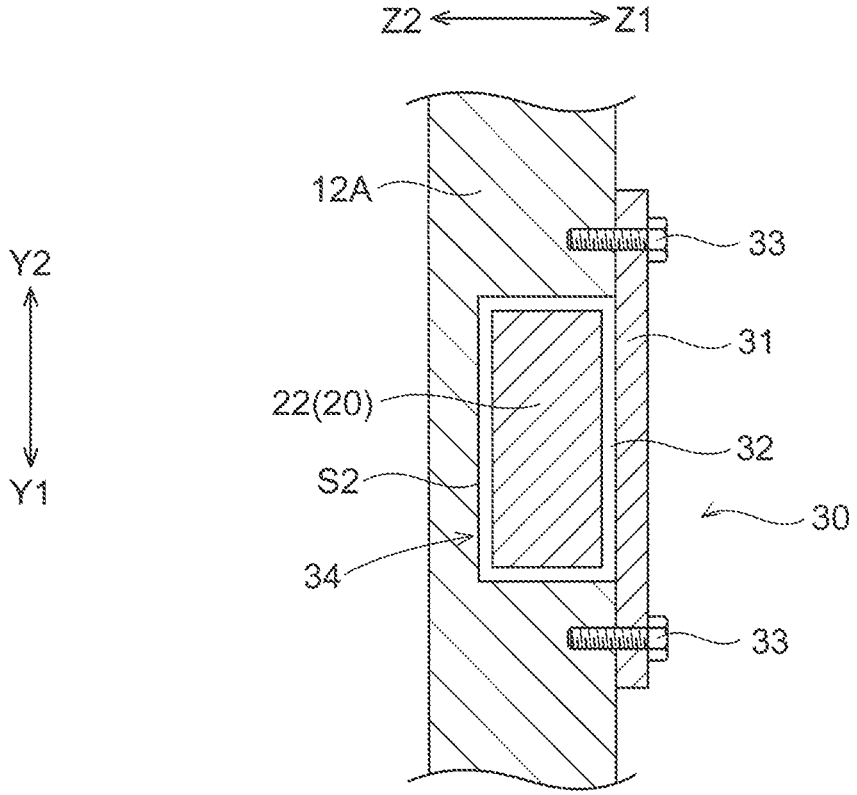
FIG. 6 is a cross-sectional view that is orthogonal to a width direction of the center rail and the outer frame (a cross-sectional view taken along VI-VI in FIG. 5).

As shown in FIGS. 5 and 6, the engaging mechanism 30 includes a surrounding portion 34 that surrounds the center rail 20 from both sides in the slide direction Y and both sides in the wall orthogonal direction Z, and the surrounding portion 34 is provided with an insertion hole 32 that penetrates therethrough in the width direction X and into which the center rail 20 is inserted. With this surrounding portion 34, it is possible to regulate the center rail 20 from moving toward either side in the slide direction Y and either side in the wall orthogonal direction Z. The surrounding portion 34 is provided with the insertion hole 32 that penetrates therethrough in the width direction X. In the present embodiment, a portion of the center rail 20 on the width direction second side X2 (here, the second portion 22) is locked to the surrounding portion 34 in the state of being inserted into the insertion hole 32. As a result, the center rail 20 can be appropriately held by the second frame portion 12.

In the present embodiment, the engaging mechanism 30 includes an engaging member 31 and a second fastening member 33.

Furthermore, in this example, the engaging mechanism 30 includes a second recessed portion S2 formed in the second front-side main body 12A of the second frame portion 12. The engaging mechanism 30 provides the surrounding portion 34 that surrounds the center rail 20 with the engaging member 31 and the second recessed portion S2.

The engaging member 31 is a member that regulates the relative movement of the center rail 20 relative to the second frame portion 12, at least in a direction toward the wall orthogonal direction first side Z1. The second fastening member 33 is a member for fixing the engaging member 31 to the second frame portion 12. The engaging member 31 is attached to the second frame portion 12 from the wall orthogonal direction first side Z1 so as to overlap both the second frame portion 12 and the center rail 20. The second fastening member 33 is inserted into the engaging member 31 and the second frame portion 12 in the wall orthogonal direction Z. Thus, the engaging member 31 is fastened to the second frame portion 12.

In the present embodiment, as shown in FIGS. 5 to 7, the second recessed portion S2 is formed in the second front-side main body 12A of the second frame portion 12. The second recessed portion S2 is formed so as to be partially recessed toward the wall orthogonal direction second side Z2 with respect to the surface of the second front-side main body 12A on the most wall orthogonal direction first side Z1. Here, the second recessed portion S2 is formed in a range in the slide direction Y so as to have a dimension no less than the dimension of the second portion 22 of the center rail 20 in the slide direction Y. The end portion of the second recessed portion S2 on the width direction first side X1 is closed. The second recessed portion S2 is formed in a range on the width direction second side X2 with respect to the position of the end portion of the center rail 20 on the width direction second side X2 in a state where the center rail 20 fixed in the fixed portion 26 has expanded to the maximum due to overheating. Here, the second recessed portion S2 is formed by being surrounded by a surface that faces toward the wall orthogonal direction first side Z1, a surface that faces toward the width direction first side X1, and a pair of surfaces that face each other in the slide direction Y. The second portion 22 of the center rail 20 fits in the second recessed portion S2. Note that the second recessed portion S2 may be formed without the surface that faces toward the width direction first side X1, and may be formed so that the end portion of the second recessed portion S2 on the width direction second side X2 is open.

As described above, the center rail 20 fits in the second recessed portion S2, and therefore the engaging member 31 in this example is a rectangular plate-shaped member elongated in the slide direction Y. As shown in FIG. 5, in this example, the side edge of the engaging member 31 on the width direction first side X1 is attached so as to align with the side edge of the second front-side main body 12A on the width direction first side X1. Also, the engaging member 31 is provided so as to span between both sides of the second recessed portion S2 in the slide direction Y. The engaging member 31 is attached to the second front-side main body 12A from the wall orthogonal direction first side Z1 using the second fastening member 33, on both sides of the second recessed portion S2 in the slide direction Y. Therefore, in this example, a pair of bolts is used as the second fastening member 33. Each of the pair of bolts is inserted into the engaging member 31 and the second front-side main body 12A from the wall orthogonal direction first side Z1. Thus, the engaging member 31 is fixed to the second front-side main body 12A.

In the present embodiment, as shown in FIG. 6, the surrounding portion 34 is constituted by a surface that faces toward the wall orthogonal direction first side Z1 in the second recessed portion S2, a pair of surfaces that face each other in the slide direction Y, and a surface that faces toward the wall orthogonal direction second side Z2 of the engaging member 31 attached to the second recessed portion S2 from the wall orthogonal direction first side Z1. As a result, the surrounding portion 34 surrounds the second portion 22 of the center rail 20 from both sides in the slide direction Y and both sides in the wall orthogonal direction Z. Meanwhile, as described above, the end portion of the second recessed portion S2 on the width direction first side X1 is closed, and therefore, as shown in FIG. 5, the surrounding portion 34 is closed on the width direction first side X1. As a result, the center rail 20 can be inserted into the surrounding portion 34 from the width direction first side X1. Thus, the surrounding portion 34 is provided with the insertion hole 32 that penetrates therethrough in the width direction X and into which the center rail 20 is inserted. The second portion 22 of the center rail 20 fits in the surrounding portion 34, and thus the center rail 20 and the second frame portion 12 are engaged with each other with the engaging mechanism 30 interposed therebetween, in a state where the relative movement of the center rail 20 relative to the second frame portion 12 in the width direction X is allowed, and the relative movement thereof in the wall orthogonal direction Z and the slide direction Y is regulated.

Also, as described above, the second recessed portion S2 is formed in a range on the width direction second side X2 with respect to the position of the end portion of the center rail 20 on the width direction second side X2 in a state where the center rail 20 has expanded to the maximum due to overheating. Therefore, as shown in FIGS. 5 and 7, at room temperature, an expansion space T is formed on the width direction second side X2 of the end portion of the center rail 20 on the width direction second side X2. In the present embodiment, the expansion space T is formed within the second recessed portion S2. With the expansion space T thus formed, even if the center rail 20 expands to the maximum due to the heat of a fire, the end portion of the center rail 20 on the width direction second side X2 is prevented from abutting against the surface of the second recessed portion S2 that faces toward the width direction first side X1. Therefore, it is possible to release the expansion of the center rail 20 in the width direction X, and it is possible to suppress the curvature of the center rail 20 from increasing. Note that the dimension of the expansion space T in the width direction X is preferably larger than the dimension of the center rail 20 in the width direction X in a state where the center rail 20 has expanded to the maximum due to the heat at the time of a fire increased from normal temperature.

1-5. Back Center Rail

The back center rail 40 is provided so as to overlap the target area 7 in a wall orthogonal direction Z view, and extend in the width direction X between the first frame portion 11 and the second frame portion 12 on the wall body 2 side with respect to the target area 7 (FIG. 4). As a result, the back center rail 40 is provided at a position at which the back center rail 40 does not overlap the opening 3 in a wall orthogonal direction Z view, and can support the door body 4 provided in the first area 5 to close the opening 3, on an area on the slide direction second side Y2, from the wall orthogonal direction second side Z2.

Figure 8:
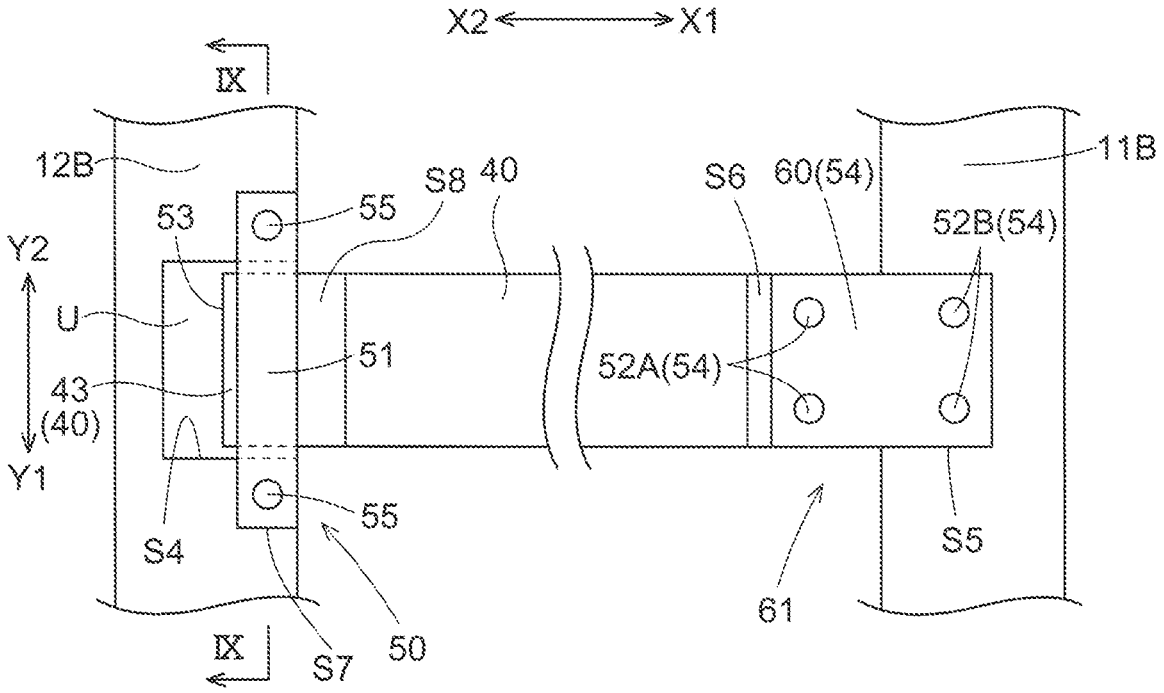
FIG. 8 is a rear view of the back center rail and the outer frame.

Also, as shown in FIGS. 7 and 8, when one of the first frame portion 11 and the second frame portion 12 is determined as a target frame portion, and the other is determined as a non-target frame portion, the back center rail 40 and the target frame portion are fixed to each other, and the back center rail 40 and the non-target frame portion are engaged with each other with a back-side engaging mechanism 50 interposed therebetween. The back-side engaging mechanism 50 is configured to allow the relative movement of the back center rail 40 relative to the non-target frame portion in the width direction X, and to regulate the relative movement thereof in the wall orthogonal direction Z and the slide direction Y. With this configuration, it is possible to engage the back-side engaging mechanism 50 with the back center rail 40 so that one end side of the back center rail 40 is fixed to the target frame portion, and the back-side engaging mechanism 50 engages with the other end side of the back center rail 40 so as to allow the other end side to move in the width direction X relative to the non-target frame portion.

Furthermore, as described above, the door body 4 thermally expands due to the heat of a fire, but in the event of a fire, the back center rail 40 also expands due to heat. With this configuration, the back center rail 40 and the target frame portion are fixed to each other, whereas the back-side engaging mechanism 50 allows the back center rail 40 to move in the width direction X relative to the non-target frame portion. Therefore, even if the back center rail 40 expands due to heat at the time of a fire, the expansion can be released in the width direction X. Therefore, it is possible to prevent the back center rail 40 from deforming due to bending or the like. Therefore, it is possible to suppress the deterioration of the back center rail 40's function of holding the door body 4. The configuration of the back-side engaging mechanism 50 will be described later in detail.

In the present embodiment, the back center rail 40 and the first frame portion 11 are fixed to each other, and the back center rail 40 and the second frame portion 12 are engaged with each other with the back-side engaging mechanism 50 interposed therebetween. That is to say, the first frame portion 11 is the target frame portion, and the second frame portion 12 is the non-target frame portion. The back center rail 40 is a member that is elongated in the width direction X. In the example shown in the drawings, the back center rail 40 is formed in a rectangular plate shape in a wall orthogonal direction Z view. The dimension of the back center rail 40 in the width direction X is set to be longer than the dimension of the door body 4. Furthermore, in this example, the dimension of the back center rail 40 in the width direction X is shorter than the dimension of the outer edge of the outer frame 10 in the width direction X. As a result, in this example, in a state where the back center rail 40 is attached to the outer frame 10, a back-side first portion 42 that overlaps the first frame portion 11 in a wall orthogonal direction Z view is formed at an end portion of the back center rail 40 on the width direction first side X1. Also, a back-side second portion 43 that overlaps the second frame portion 12 in a wall orthogonal direction Z view is formed at an end portion of the back center rail 40 on the width direction second side X2. In this example, a portion of the back center rail 40 excluding the back-side first portion 42 and the back-side second portion 43 is defined as a non-overlapping portion 41. As shown in FIG. 7, the dimension of the non-overlapping portion 41 in the wall orthogonal direction Z is set to be larger than the dimension of the back-side first portion 42 and the back-side second portion 43 in the wall orthogonal direction Z.

Next, the configuration of a portion in which the back center rail 40 and the first frame portion 11 are fixed to each other, i.e., the configuration of a back-side fixing portion 61, will be described. As shown in FIGS. 7 and 8, in the back-side fixing portion 61, the back center rail 40 overlaps the first frame portion 11 and is fixed by a back-side fixing member 54. The back-side fixing portion 61 is located in an area of the back center rail 40 on the width direction first side X1, which includes the back-side first portion 42. In this example, the back-side first portion 42 of the back center rail 40 is placed on top of the first frame portion 11 and is fixed by the back-side fixing member 54 to form the back-side fixing portion 61.

The back-side fixing member 54 includes a back-side plate-shaped member 60 that has a flat plate shape, and a third fastening member 52. In this example, the third fastening member 52 includes a third fastening bolt 52A and a fourth fastening bolt 52B. The third fastening bolt 52A is inserted through the back-side plate-shaped member 60 and the back center rail 40 in the wall orthogonal direction Z, and fastens them to each other. The fourth fastening bolt 52B is inserted through the back-side plate-shaped member 60 and the first frame portion 11 in the wall orthogonal direction Z, and fastens them to each other. Note that, in the example shown in the drawings, bolts that protrude less than the first fastening bolt 24A and the second fastening bolt 24B toward the wall orthogonal direction second side Z2, namely flat-head bolts, are used as the third fastening bolt 52A and the fourth fastening bolt 52B.

In the present embodiment, the back-side plate-shaped member 60 has a rectangular shape that is elongated in the width direction X. Also, in this example, the back-side plate-shaped member 60 has the same dimension as the back center rail 40 in the slide direction Y. The dimension of the back-side plate-shaped member 60 in the width direction X is longer than the dimension of the back-side first portion 42.

In the example shown in the figures, the back-side plate-shaped member 60 fits in the recessed portions formed in the first frame portion 11 and the back center rail 40 so as not to protrude toward the wall orthogonal direction second side Z2 relative to the first frame portion 11 and the back center rail 40. Specifically, a fifth recessed portion S5 is formed in the first frame portion 11, a sixth recessed portion S6 is formed in the back center rail 40, and the back-side plate-shaped member 60 is located so as to fit in these recessed portions. The fifth recessed portion S5 and the sixth recessed portion S6 are formed so that these recessed portions are combined to form a shape that matches the shape of the back-side plate-shaped member 60. The fifth recessed portion S5 is formed in the first wall-side main body 11B so that the surface of the first wall-side main body 11B of the first frame portion 11 on the most wall orthogonal direction second side Z2 is partially recessed toward the wall orthogonal direction first side Z1. The sixth recessed portion S6 is formed in the back center rail 40 so that the surface of the back center rail 40 on the most wall orthogonal direction second side Z2 is partially recessed toward the wall orthogonal direction first side Z1. In this example, the sixth recessed portion S6 is formed along the entire range of the back center rail 40 in the slide direction Y.

In the present embodiment, as shown in FIG. 7, a third recessed portion S3 is formed in the first wall-side main body 11B of the first frame portion 11. The third recessed portion S3 is formed in an area that overlaps the fifth recessed portion S5 when viewed in the direction orthogonal to the wall. The third recessed portion S3 is formed so as to be recessed further than the fifth recessed portion S5 toward the wall orthogonal direction first side Z1. Here, the third recessed portion S3 is formed in a range in the slide direction Y so as to have a dimension no less than the dimension of the back-side first portion 42 of the back center rail 40 in the slide direction Y. Also, the third recessed portion S3 is formed by being surrounded by a surface that faces toward the wall orthogonal direction second side Z2, a surface that faces toward the width direction second side X2, and a pair of surfaces that face each other in the slide direction Y. The back-side first portion 42 of the back center rail 40 fits in the third recessed portion S3. In this example, the fifth recessed portion S5 is formed so as to have the same dimension as the third recessed portion S3 in the slide direction Y, and so as to be longer than the third recessed portion S3 in the width direction X.

As shown in FIGS. 7 and 8, the back-side plate-shaped member 60 fits in the fifth recessed portion S5 and the sixth recessed portion S6 in the state where the back-side first portion 42 of the back center rail 40 fits in the third recessed portion S3. The back-side plate-shaped member 60 is placed on top of the back center rail 40 and the first wall-side main body 11B from the wall orthogonal direction second side Z2. The third fastening bolt 52A is inserted into the back-side plate-shaped member 60 and the back center rail 40 from the wall orthogonal direction second side Z2, and the back-side plate-shaped member 60 and the back center rail 40 are fastened to each other. Also, the fourth fastening bolt 52B is inserted into the back-side plate-shaped member 60 and the first wall-side main body 11B from the wall orthogonal direction second side Z2, and the back-side plate-shaped member 60 and the first wall-side main body 11B are fastened to each other. With this configuration, the first wall-side main body 11B of the first frame portion 11 and the back center rail 40 are fixed to each other with the back-side plate-shaped member 60 interposed therebetween.

1-6. Back-Side Engaging Mechanism

The back-side engaging mechanism 50 is configured to allow the relative movement of the back center rail 40 relative to the non-target frame portion in the width direction X, and to regulate the relative movement thereof in the wall orthogonal direction Z and the slide direction Y.

With this configuration, even if the back center rail 40 expands due to heat at the time of a fire, the expansion can be released in the width direction X. Furthermore, the back-side engaging mechanism 50 is configured to regulate the back center rail 40 from moving in the wall orthogonal direction Z or the slide direction Y relative to the non-target frame portion.

With this configuration, the position of the non-target frame portion of the back center rail 40, specifically the position thereof in the wall orthogonal direction Z and the slide direction Y can be appropriately kept at the same position.

Figure 9:
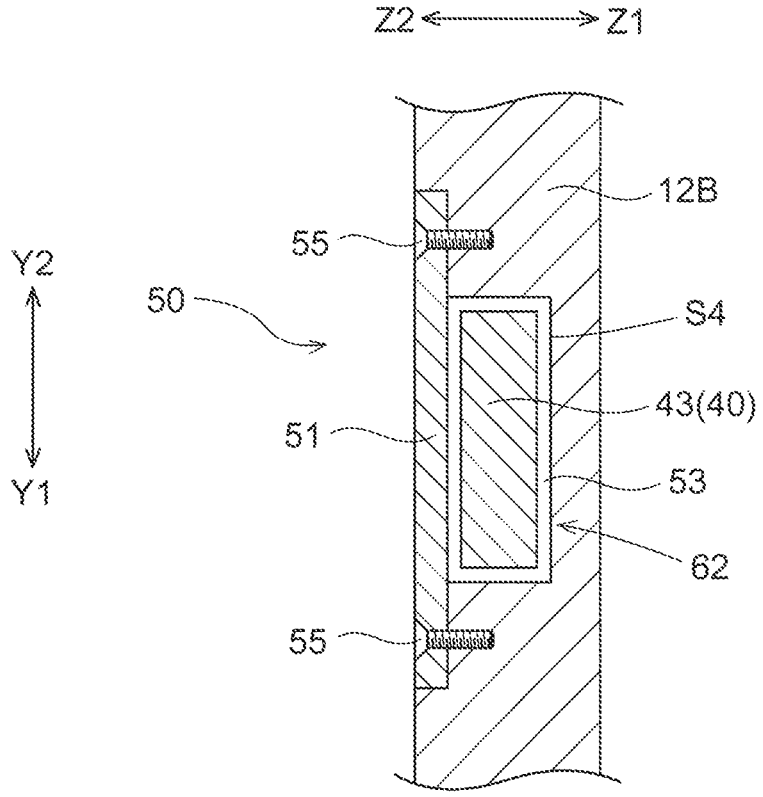
FIG. 9 is a cross-sectional view that is orthogonal to a width direction of the back center rail and the outer frame (a cross-sectional view taken along IX-IX in FIG. 8).

As shown in FIGS. 8 and 9, the back-side engaging mechanism 50 includes a back-side surrounding portion 62 that surrounds the back center rail 40 from both sides in the slide direction Y and both sides in the wall orthogonal direction Z, and the back-side surrounding portion 62 is provided with a back-side insertion hole 53 that penetrates therethrough in the width direction X and into which the back center rail 40 is inserted. With this back-side surrounding portion 62, it is possible to regulate the back center rail 40 from moving toward either side in the slide direction Y and either side in the wall orthogonal direction Z. The back-side surrounding portion 62 is provided with the back-side insertion hole 53 that penetrates therethrough in the width direction X. In the present embodiment, a portion of the back center rail 40 on the width direction second side X2 (here, the back-side second portion 43) is locked to the back-side surrounding portion 62 in the state of being inserted into the back-side insertion hole 53. As a result, the back center rail 40 can be appropriately held by the back-side second portion 43.

In the present embodiment, the back-side engaging mechanism 50 includes a back-side engaging member 51 and a fourth fastening member 55. Furthermore, in this example, the back-side engaging mechanism 50 includes a fourth recessed portion S4 and a seventh recessed portion S7 formed in the second wall-side main body 12B of the second frame portion 12. The back-side engaging mechanism 50 provides the back-side surrounding portion 62 that surrounds the back center rail 40 with the back-side engaging member 51 and the fourth recessed portion S4.

The back-side engaging member 51 is a member that regulates the relative movement of the back center rail 40 relative to the second frame portion 12, at least in a direction toward the wall orthogonal direction second side Z2. The fourth fastening member 55 is a member for fixing the back-side engaging member 51 to the second frame portion 12. The back-side engaging member 51 is attached to the second frame portion 12 from the wall orthogonal direction second side Z2 so as to overlap both the second frame portion 12 and the back center rail 40.

The fourth fastening member 55 is inserted into the back-side engaging member 51 and the second frame portion 12 in the wall orthogonal direction Z. Thus, the back-side engaging member 51 is fastened to the second frame portion 12.

In the present embodiment, as shown in FIGS. 7 to 9, the fourth recessed portion S4 is formed in the second wall-side main body 12B of the second frame portion 12. The fourth recessed portion S4 is formed so as to be partially recessed toward the wall orthogonal direction first side Z1 with respect to the surface of the second wall-side main body 12B on the most wall orthogonal direction second side Z2. Here, the fourth recessed portion S4 is formed in a range in the slide direction Y so as to have a dimension no less than the dimension of the back-side second portion 43 of the back center rail 40 in the slide direction Y. The end portion of the fourth recessed portion S4 on the width direction first side X1 is open. The fourth recessed portion S4 is formed in a range on the width direction second side X2 with respect to the position of the end portion of the back center rail 40 on the width direction second side X2 in a state where the back center rail 40 fixed in the back-side fixing portion 61 has expanded to the maximum due to overheating. Here, the fourth recessed portion S4 is formed by being surrounded by a surface that faces toward the wall orthogonal direction second side Z2, a surface that faces toward the width direction first side X1, and a pair of surfaces that face each other in the slide direction Y. The back-side second portion 43 of the back center rail 40 fits in the fourth recessed portion S4. Note that the fourth recessed portion S4 may be formed without the surface that faces toward the width direction first side X1, and may be formed so that the end portion of the fourth recessed portion S4 on the width direction second side X2 is open.

In the example shown in the figures, the back-side engaging member 51 fits in the recessed portions formed in the second frame portion 12 and the back center rail 40 so as not to protrude toward the wall orthogonal direction second side Z2 relative to the second frame portion 12 and the back center rail 40. Specifically, the seventh recessed portion S7 is formed in the second frame portion 12, an eighth recessed portion S8 is formed in the back center rail 40, and the back-side engaging member 51 is located so as to fit in these recessed portions (FIG. 8). The seventh recessed portion S7 is separately located on both sides in the slide direction Y with respect to the fourth recessed portion S4. On each side, the seventh recessed portion S7 is formed in the second wall-side main body 12B so as to be partially recessed toward the wall orthogonal direction first side Z1 with respect to the surface of the second wall-side main body 12B of the second frame portion 12 on the most wall orthogonal direction second side Z2. The seventh recessed portion S7 is formed so as to match the shape of the back-side engaging member 51. Also, the seventh recessed portion S7 is formed so as to align with the side edge of the second wall-side main body 12B on the width direction first side X1. The eighth recessed portion S8 is formed in the back center rail 40 so that the surface of the back center rail 40 on the most wall orthogonal direction second side Z2 is partially recessed toward the wall orthogonal direction first side Z1. In this example, the eighth recessed portion S8 is formed along the entire range of the back center rail 40 in the slide direction Y.

In the present embodiment, the back-side engaging member 51 has a rectangular shape that is elongated in the slide direction Y. As shown in FIG. 8, in this example, the side edge of the back-side engaging member 51 on the width direction first side X1 is attached so as to align with the side edge of the second wall-side main body 12B on the width direction first side X1. Also, the back-side engaging member 51 is provided so as to span between both sides of the fourth recessed portion S4 in the slide direction Y.

As shown in FIGS. 8 and 9, the back-side engaging member 51 is attached to the second wall-side main body 12B from the wall orthogonal direction second side Z2 using the fourth fastening member 55, on both sides of the fourth recessed portion S4 in the slide direction Y. Therefore, in this example, a pair of bolts is used as the fourth fastening member 55. Each of the pair of bolts is inserted into the back-side engaging member 51 and the second wall-side main body 12B from the wall orthogonal direction second side Z2. In this example, the pair of bolts are respectively located in a pair of areas of the seventh recessed portion S7, which are separately formed on the two sides of the fourth recessed portion S4 in the slide direction Y. Thus, the back-side engaging member 51 is fixed to the second wall-side main body 12B. Note that, in the example shown in the figures, bolts that protrude less than the second fastening member 33 toward the wall orthogonal direction second side Z2, namely flat-head bolts, are used as bolts that are included in the fourth fastening member 55.

In the present embodiment, as shown in FIG. 9, the back-side surrounding portion 62 is constituted by a surface that faces toward the wall orthogonal direction second side Z2 in the fourth recessed portion S4, a pair of surfaces that face each other in the slide direction Y, and a surface that faces toward the wall orthogonal direction first side Z1 of the back-side engaging member 51. As a result, the back-side surrounding portion 62 surrounds the back-side second portion 43 of the back center rail 40 from both sides in the slide direction Y and both sides in the wall orthogonal direction Z. Meanwhile, as described above, the end portion of the fourth recessed portion S4 on the width direction first side X1 is open, and therefore, as shown in FIG. 8, the back-side surrounding portion 62 is open on the width direction first side X1. As a result, the back center rail 40 can be inserted into the back-side surrounding portion 62 from the width direction first side X1. Thus, the back-side surrounding portion 62 is provided with the back-side insertion hole 53 that penetrates therethrough in the width direction X and into which the back center rail 40 is inserted. The back-side second portion 43 of the back center rail 40 fits in the back-side surrounding portion 62, and thus the back center rail 40 and the back-side second portion 43 are engaged with each other with the back-side engaging mechanism 50 interposed therebetween, in a state where the relative movement of the back center rail 40 relative to the back-side second portion 43 in the width direction X is allowed, and the relative movement thereof in the wall orthogonal direction Z and the slide direction Y is regulated.

Also, as described above, the fourth recessed portion S4 is formed in a range on the width direction second side X2 with respect to the position of the end portion of the back center rail 40 on the width direction second side X2 in a state where the back center rail 40 has expanded to the maximum due to overheating. Therefore, as shown in FIGS. 7 and 8, at room temperature, an expansion space U is formed on the width direction second side X2 of the end portion of the back center rail 40 on the width direction second side X2. In the present embodiment, the expansion space U is formed within the fourth recessed portion S4. With the expansion space U thus formed, even if the back center rail 40 expands to the maximum due to the heat of a fire, the end portion of the back center rail 40 on the width direction second side X2 is prevented from abutting against the surface of the fourth recessed portion S4 that faces toward the width direction first side X1. Therefore, it is possible to release the expansion of the back center rail 40 in the width direction X, and it is possible to suppress the curvature of the back center rail 40 from increasing. Note that the dimension of the expansion space U in the width direction X is preferably larger than the dimension of the back center rail 40 in the width direction X in a state where the back center rail 40 has expanded to the maximum due to the heat at the time of a fire increased from normal temperature.

2. Other Embodiments

Next, other embodiments of the fire door 1 will be described.

(1) The above embodiment describes, as an example, a configuration in which the slide direction Y of the door body 4 determined by the outer frame 10 is the top-bottom direction (the vertical direction). However, the present invention is not limited to such a configuration, and for example, the slide direction Y may be a direction parallel to the horizontal direction, and the door body 4 may be supported so as to be movable in a direction parallel to the horizontal direction. Alternatively, the slide direction Y may be set to a direction that is inclined relative to both the top-bottom direction and the horizontal direction.

(2) The above embodiment describes, as an example, a configuration in which the third frame portion 13 and the fourth frame portion 14 are included in the outer frame 10 in addition to the first frame portion 11 and the second frame portion 12. However, the present invention is not limited to such a configuration, and the outer frame 10 need only include the first frame portion 11 and the second frame portion 12, and may be formed without the third frame portion 13 and the fourth frame portion 14. Even in this case, the door body 4 is configured to be guided by the first frame portion 11 and the second frame portion 12 so as to be movable in the slide direction Y. However, the positional relationship between the first frame portion 11 and the second frame portion 12 needs to be fixed, and therefore, it is preferable to employ a configuration that additionally includes a connection member that connects the first frame portion 11 and the second frame portion 12 to each other, for example. Alternatively, if such a connection member is not included, the first frame portion 11 and the second frame portion 12 may each be fixed to the wall body 2.

(3) The embodiment describes, as an example, a configuration in which the first portion 21, which is the portion that overlaps the first frame portion 11 in a wall orthogonal direction Z view, of the center rail 20, is fixed to the first frame portion 11, and the second portion 22, which is the portion that overlaps the second frame portion 12 in a wall orthogonal direction Z view, is engaged with the second frame portion 12, with the engaging mechanism 30 interposed therebetween. However, the present invention is not limited to such a configuration. For example, it is possible to employ a configuration in which a portion of the center rail 20 that does not overlap the first frame portion 11 in a wall orthogonal direction Z view is fixed to the first frame portion 11. Specifically, the end portion of the center rail 20 on the width direction first side X1 may be fixed to the surface of the first frame portion 11 that faces toward the width direction second side X2. Alternatively, for example, it is possible to employ a configuration in which a portion of the center rail 20 that does not overlap the second frame portion 12 in a wall orthogonal direction Z view is engaged with the second frame portion 12 with the engaging mechanism 30 interposed therebetween. Specifically, the portion of the center rail 20 that is on the width direction second side X2 relative to the portion that overlaps the second frame portion 12 in a wall orthogonal direction Z view is engaged with the second frame portion 12, with the engaging mechanism 30 interposed therebetween located on the width direction second side X2 relative to the second frame portion 12.

(4) The embodiment above describes, as an example, a configuration in which the moving range of the door body 4 in the slide direction Y is set so that the first area 5 and the second area 6, in which the door body 4 is to be located have an overlapping area 8 where they partially overlap each other. However, the present invention is not limited to such a configuration, and, for example, it is possible to employ a configuration in which the first area 5 and the second area 6 do not overlap each other. Even in such a case, the center rail 20 is located so as to overlap the target area 7 in a wall orthogonal direction Z view. As a result, the opening 3 is not narrowed by the center rail 20, and when the door body 4 is located in the first area 5 to close the opening 3, the door body 4 can be appropriately reinforced by the center rail 20.

(5) The embodiment above describes, as an example, a configuration in which the center rail 20 is located so as to overlap the overlapping area 8 in a wall orthogonal direction Z view. However, the present invention is not limited to such a configuration, and, for example, it is possible to employ a configuration in which the center rail 20 does not overlap the overlapping area 8 in a wall orthogonal direction Z view, and only overlaps the target area 7. Even with such a configuration, in a state where the door body 4 is located in the first area 5 to close the opening 3, the door body 4 can be appropriately reinforced.

(6) The embodiment above describes, as an example, a configuration in which the engaging mechanism 30 includes the second recessed portion S2 formed in the second front-side main body 12A of the second frame portion 12 and the plated-shaped engaging member 31 located so as to cover the second recessed portion S2 from the wall orthogonal direction first side Z1. However, the present invention is not limited to such a configuration. For example, it is possible to employ a configuration in which the second recessed portion S2 is not formed in the second frame portion 12 and a recessed portion in which the center rail 20 fits is formed in the engaging member 31. Alternatively, it is possible to employ a configuration in which a recessed portion is formed in both the second frame portion 12 and the engaging member 31, and the center rail 20 fits in these recessed portions. In these cases, the engaging member 31 may be, for example, a plate-shaped member that is bent so that the portion corresponding to the recessed portion has a U-shape that is angular when viewed in the width direction X.

(7) The embodiment above describes, as an example, a configuration in which that engaging mechanism 30 includes the surrounding portion 34 that surrounds the center rail 20 from both sides in the slide direction Y and both sides in the wall orthogonal direction Z. However, the present invention is not limited to such a configuration. For example, the engaging mechanism 30 may include a surrounding portion 34 that surrounds the center rail 20 from both sides in the slide direction Y and either one side in the wall orthogonal direction Z. Also, the configuration of the engaging mechanism 30 is not limited to including such a surrounding portion 34. For example, the engaging mechanism 30 may include a linear motion guide mechanism (a linear guide) that is located between the surface of the center rail 20 that faces toward the wall orthogonal direction second side Z2 and the surface of the second frame portion 12 that faces toward the wall orthogonal direction first side Z1. In this case, the linear motion guide mechanism is provided so as to allow the relative movement of the center rail 20 relative to the second frame portion 12 in the width direction X, and regulate the relative movement thereof in the wall orthogonal direction Z and the slide direction Y. Note that the same applies to the back-side engaging mechanism 50 of the back center rail 40.

(8) The above embodiment describes, as an example, a configuration in which the distance L between the first facing surface F1 of the first frame portion 11 and the second facing surface F2 of the second frame portion 12 in the width direction X is larger than the dimension N obtained by adding the amount of expansion of the door body 4 in the width direction X caused by overheating at the time of fire to the dimension M of the door body 4 in the width direction X at room temperature. However, the present invention is not limited to such a configuration. For example, it is possible to employ a configuration in which the distance L between the first facing surface F1 of the first frame portion 11 and the second facing surface F2 of the second frame portion 12 in the width direction X is equal to the dimension N obtained by adding the amount of expansion of the door body 4 in the width direction X caused by overheating at the time of fire to the dimension M of the door body 4 in the width direction X at room temperature.

(9) The above embodiment describes, as an example, a configuration in which the back center rail 40 and the first frame portion 11 are fixed to each other, and the back center rail 40 and the second frame portion 12 are engaged with each other with the back-side engaging mechanism 50 interposed therebetween, i.e., a configuration in which, as shown in FIG. 7, the back center rail 40 is also fixed to the frame portion on the side where the center rail 20 is fixed (the first frame portion 11), and the back center rail 40 is also engaged with the frame portion on the side where the center rail 20 is engaged with the engaging mechanism 30 interposed therebetween (the second frame portion 12), with the back-side engaging mechanism 50 interposed therebetween. However, the present invention is not limited to such a configuration. For example, it is possible to employ a configuration in which the back center rail 40 is engaged with the frame portion on the side where the center rail 20 is fixed (the first frame portion 11), with the back-side engaging mechanism 50 interposed therebetween, and the back center rail 40 is fixed to the frame portion on the side where the center rail 20 is engaged with the engaging mechanism 30 interposed therebetween (the second frame portion 12).

(10) The above embodiment describes, as an example, a configuration that includes the back center rail 40 that is provided so as to extend in the width direction X between the first frame portion 11 and the second frame portion 12. However, the present invention is not limited to such a configuration. For example, it is possible to employ a configuration in which the fire door 1 is not provided with the back center rail 40.

(11) The above embodiment describes, as an example, a configuration in which bolts are used in the fixing member 25 as the first fastening member 24 to fix the center rail 20 and the first frame portion 11 to each other. However, the present invention is not limited to such a configuration. The center rail 20 and the first frame portion 11 may be fixed by using, for example, a fastening member other than a bolt, such as a rivet, or through welding. The same applies to the fixing of the engaging member 31 and the second frame portion 12, the fixing of the back center rail 40 and the target frame portion, and the fixing of the back-side engaging member 51 and the non-target frame portion.

(12) Note that the configurations disclosed in each of the above-described embodiments can be applied in combination with the configurations disclosed in other embodiments as long as there is no contradiction. With respect to other configurations, the embodiments disclosed herein are merely exemplary in all respects. Therefore, various modifications can be made as appropriate without departing from the spirit of the present disclosure.

3. Summary of Above-described Embodiments

The following describes a summary of the above-described fire door.

The fire door is a fire door that is to be attached to a wall surface of a wall body that has an opening, the fire door including: an outer frame that is fixed to the wall body; a door body that is guided by the outer frame so as to move in a slide direction along the wall surface, thereby opening and closing the opening; and a center rail that is attached to the outer frame, an area in which the door body is located in a state where the opening is closed is defined as a first area, an area in which the door body is located in a state where the opening is open is defined as a second area, a direction that is orthogonal to the wall surface of the wall body is defined as a wall orthogonal direction, a direction that is orthogonal to the slide direction in a wall orthogonal direction view that is a view in the wall orthogonal direction is defined as a width direction, the first area side with respect to the second area in the slide direction is defined as a slide direction first side, and the second area side with respect to the first area in the slide direction is defined as a slide direction second side, the outer frame includes a first frame portion that is located on a width direction first side that is one side in the width direction with respect to the first area and the second area, so as to extend in the slide direction, and a second frame portion that is located on a width direction second side that is the other side in the width direction with respect to the first area and the second area, so as to extend in the slide direction, the center rail is provided so as to overlap a target area in the wall orthogonal direction view, where the target area is an area on the slide direction second side in the first area with respect to the opening in the wall orthogonal direction view, and so as to extend in the width direction between the first frame portion and the second frame portion on the side opposite to the wall body with respect to the target area, the center rail and the first frame portion are fixed to each other, and the center rail and the second frame portion are engaged with each other with an engaging mechanism interposed therebetween, and the engaging mechanism is configured to allow relative movement of the center rail relative to the second frame portion in the width direction, and to regulate the relative movement thereof in the wall orthogonal direction and the slide direction.

With this configuration, the center rail can hold the target area of the door body from the side opposite to the wall body. Therefore, it is possible to prevent the gap between the door body and the wall body from increasing as a result of the door body expanding in a direction away from the wall body. In addition, the center rail itself also expands due to heat. However, while the center rail and the first frame portion are fixed to each other, the engaging mechanism is configured to allow the relative movement of the center rail relative to the second frame portion in the width direction. Therefore, even if the center rail expands due to heat at the time of a fire, the expansion can be released in the width direction so as to prevent the center rail from bending in a direction away from the door body and increasing the gap with the door body. Therefore, it is possible to suppress the deterioration of the center rail's function of holding the door body resulting from the expansion of the center rail.

As described above, with this configuration, in the case of a slidable fire door, it is possible to suppress the expansion of the gap with the door body due to the expansion of the center rail, and suppressing the deterioration of the center rail's function of holding the door body.

Here, when a portion that overlaps the first frame portion in the wall orthogonal direction view, of the center rail, is defined as a first portion, and a portion of the center rail that overlaps the second frame portion in the wall orthogonal direction view, of the center rail, is defined as a second portion, it is preferable that the first portion is fixed to the first frame portion, and the second portion is engaged with the second frame portion with the engaging mechanism interposed therebetween.

With this configuration, the first portion that overlaps the first frame portion, of the center rail, is fixed to the first frame portion, and therefore the center rail and the first frame portion can be firmly fixed to each other using a simple configuration. Also, the second frame portion that overlaps the second portion, of the center rail, is engaged with the second frame portion with the engaging mechanism interposed therebetween, and therefore it is easier to realize the engaging mechanism with a simple configuration.

In addition, it is preferable that a moving range of the door body in the slide direction is set so that the first area and the second area partially overlap each other, and when an area where the first area and the second area overlap each other is defined as an overlapping area, the center rail is located so as to overlap the overlapping area in the wall orthogonal direction view.

With this configuration, the center rail is located at a position at which the center rail overlaps the door body in a wall orthogonal direction view in both the state where the door body closes the opening and the state where the door body opens the opening. Therefore, the center rail can appropriately reinforce the door body in both the case of a fire and the case of a normal time when no fire has occurred.

Also, it is preferable that he engaging mechanism includes a surrounding portion that surrounds the center rail from both sides in the slide direction and both sides in the wall orthogonal direction, and the surrounding portion is provided with a through hole that penetrates therethrough in the width direction and into which the center rail is inserted.

With this configuration, the center rail engages with the second frame portion in the state of being inserted into the insertion hole surrounded by the surrounding portion. Therefore, even if the center rail expands due to heat at the time of a fire, the expansion can be appropriately released in the width direction, and the center rail is prevented from being removed from the second frame portion, and the state in which the center rail and the second frame portion are engaged with each other can be appropriately maintained.

Also, when a surface that faces the door body in the width direction of the first frame portion is defined as a first facing surface, and a surface that faces the door body in the width direction of the second frame portion is defined as a second facing surface, it is preferable that a distance between the first facing surface and the second facing surface in the width direction is larger than a dimension obtained by adding an amount of expansion of the door body in the width direction, caused by overheating at the time of fire, to a dimension of the door body in the width direction at room temperature.

With this configuration, the distance between the first facing surface and the second facing surface of the outer frame in the width direction is longer than the dimension of the door body in the width direction after the door body has expanded due to heat at the time of a fire. Therefore, the door body is prevented by the first frame portion and the second frame portion from expanding in the width direction, and accordingly the door body can be prevented from bending in the wall orthogonal direction. Therefore, it is possible to prevent the gap between the door body and the wall body or the outer frame from increasing as a result of the door body bending due to the expansion thereof.

Also, it is preferable that the fire door further includes: a back center rail that is provided so as to overlap the target area in the wall orthogonal direction view, and extend in the width direction between the first frame portion and the second frame portion on the wall body side with respect to the target area, wherein either the first frame portion or the second frame portion is defined as a target frame portion, and the other is defined as a non-target frame portion, the back center rail and the target frame portion are fixed to each other, and the back center rail and the non-target frame portion are engaged with each other with a back-side engaging mechanism interposed therebetween, and the back-side engaging mechanism is configured to allow relative movement of the back center rail relative to the non-target frame portion in the width direction, and to regulate the relative movement thereof in the wall orthogonal direction and the slide direction.

With this configuration, the back center rail can hold the target area of the door body from the wall body side. Therefore, it is possible to prevent the gap between the door body and the wall body from increasing as a result of the door body expanding toward the wall body. In addition, the center rail itself also expands due to heat. However, while the center rail and the first frame portion are fixed to each other, the engaging mechanism is configured to allow the relative movement of the center rail relative to the second frame portion in the width direction. Therefore, even if the center rail expands due to heat at the time of a fire, the expansion can be released in the width direction so as to prevent the center rail from bending in a direction away from the door body and increasing the gap with the door body. Therefore, it is possible to suppress the deterioration of the back center rail's function of holding the door body resulting from the expansion of the back center rail.

INDUSTRIAL APPLICABILITY

The technology according to the present disclosure is applicable to a slidable fire door that is provided in a wall body that has an opening.

What is claimed is:

1. A fire door that is to be attached to a wall surface of a wall body that has an opening, the fire door comprising:

an outer frame that is fixed to the wall body;

a door body that is guided by the outer frame so as to move in a slide direction along the wall surface, thereby opening and closing the opening; and a center rail that is attached to the outer frame, wherein:

an area in which the door body is located in a state where the opening is closed is defined as a first area, an area in which the door body is located in a state where the opening is open is defined as a second area, a direction that is orthogonal to the wall surface of the wall body is defined as a wall orthogonal direction, a direction that is orthogonal to the slide direction in a wall orthogonal direction view that is a view in the wall orthogonal direction is defined as a width direction, the first area side with respect to the second area in the slide direction is defined as a slide direction first side, and the second area side with respect to the first area in the slide direction is defined as a slide direction second side, the outer frame includes a first frame portion that is located on a width direction first side that is one side in the width direction with respect to the first area and the second area so as to extend in the slide direction, and a second frame portion that is located on a width direction second side that is the other side in the width direction with respect to the first area and the second area so as to extend in the slide direction, the center rail is provided so as to overlap a target area in the wall orthogonal direction view, where the target area is an area on the slide direction second side in the first area with respect to the opening in the wall orthogonal direction view, and so as to extend in the width direction between the first frame portion and the second frame portion on the side opposite to the wall body with respect to the target area, the center rail and the first frame portion are fixed to each other so as to prohibit movement of the center rail relative to the first frame portion in the slide direction, the width direction, and the wall orthogonal direction, and the center rail and the second frame portion are engaged with each other with an engaging mechanism interposed therebetween, the engaging mechanism is configured to allow relative movement of the center rail relative to the second frame portion in the width direction, and to regulate the relative movement thereof in the wall orthogonal direction and the slide direction, a portion of the center rail that overlaps the first frame portion in the wall orthogonal direction view, of the center rail, is defined as a first portion, a portion of the center rail that overlaps the second frame portion in the wall orthogonal direction view, of the center rail, is defined as a second portion, the first portion is fixed to the first frame portion, and the second portion is engaged with the second frame portion with the engaging mechanism interposed therebetween, one side in the wall orthogonal direction on which the center rail is disposed relative to the door body is defined as a wall orthogonal direction first side, and the other side in the wall orthogonal direction on which the wall body is disposed relative to the door body is defined as a wall orthogonal direction second side, the first frame portion includes a first front-side main body having a portion facing the door body from the wall orthogonal direction first side, the second frame portion includes a second front-side main body having a portion facing the door body from the wall orthogonal direction first side, the first portion of the center rail is accommodated in a space in the first front-side main body, the second portion of the center rail is accommodated in a space in the second front-side main body, and the center rail is disposed so as not to protrude on the wall orthogonal direction first side from the first frame portion and the second frame portion.

2. The fire door according to claim 1, wherein a moving range of the door body in the slide direction is set so that the first area and the second area partially overlap each other, and wherein where the first area and the second area overlap each other is defined as an overlapping area, the center rail is located so as to overlap the overlapping area in the wall orthogonal direction view.

3. The fire door according to claim 1, wherein the engaging mechanism includes a surrounding portion that surrounds the center rail from both sides in the slide direction and both sides in the wall orthogonal direction, and wherein the surrounding portion is provided with a through hole that penetrates therethrough in the width direction and into which the center rail is inserted.

4. The fire door according to claim 1, wherein a surface that faces the door body in the width direction of the first frame portion is defined as a first facing surface, and a surface that faces the door body in the width direction of the second frame portion is defined as a second facing surface, and wherein a distance between the first facing surface and the second facing surface in the width direction is larger than a dimension obtained by adding an amount of expansion of the door body in the width direction, caused by overheating at the time of fire, to a dimension of the door body in the width direction at room temperature.

5. The fire door according to claim 1, further comprising:

a back center rail that is provided so as to overlap the target area in the wall orthogonal direction view, and extend in the width direction between the first frame portion and the second frame portion on the wall body side with respect to the target area, wherein either the first frame portion or the second frame portion is defined as a target frame portion, and the other is defined as a non-target frame portion, wherein the back center rail and the target frame portion are fixed to each other, and the back center rail and the non-target frame portion are engaged with each other with a back-side engaging mechanism interposed therebetween, and wherein the back-side engaging mechanism is configured to allow relative movement of the back center rail relative to the non-target frame portion in the width direction, and to regulate the relative movement thereof in the wall orthogonal direction and the slide direction.

6. The fire door according to claim 1, wherein the space in the second front-side main body has a dimension which extends from a side edge on the width direction first side of the second front-side main body to a portion of the second-front side main body on the width direction second side relative to a position of an end portion on the width direction second side of the center rail fixed to the first frame portion, and the space is configured to accommodate a maximum length of the center rail when the center rail has undergone heat expansion.

* * * * *